US010086990B2

(12) United States Patent
Hengami

(10) Patent No.: US 10,086,990 B2
(45) Date of Patent: Oct. 2, 2018

(54) THUMB ACTION CANDY AND MINT BOX

(71) Applicant: David Todjar Hengami, Torrance, CA (US)

(72) Inventor: David Todjar Hengami, Torrance, CA (US)

( * ) Notice: Subject to any disclaimer, the term of this patent is extended or adjusted under 35 U.S.C. 154(b) by 0 days.

(21) Appl. No.: 15/186,203

(22) Filed: Jun. 17, 2016

(65) Prior Publication Data

US 2017/0362019 A1 Dec. 21, 2017

(51) Int. Cl.

| | |
|---|---|
| ***B65D 85/60*** | (2006.01) |
| ***B65D 5/16*** | (2006.01) |
| ***B65D 5/42*** | (2006.01) |
| ***B65D 5/72*** | (2006.01) |

(52) U.S. Cl.

CPC ..... *B65D 85/60* (2013.01); *B65D 5/16* (2013.01); *B65D 5/4266* (2013.01); *B65D 5/723* (2013.01)

(58) Field of Classification Search

CPC ..... B65D 5/723; B65D 75/5894; B65D 5/64; B65D 5/72; B31B 1/26; B31B 1/162

USPC .... 229/129.1, 131.1, 220, 125.12, 210, 125, 229/125.08, 125.125, 122; 493/150, 162; 206/540, 536, 468, 532; 220/345.3, 220/345.2, 345.1; 222/565

See application file for complete search history.

(56) References Cited

U.S. PATENT DOCUMENTS 958,707 A * 5/1910 Stafford ..... B65D 5/723 229/125.12
1,951,274 A 3/1934 Denman
2,330,926 A 10/1943 Rous
2,342,081 A * 2/1944 Kirkland ..... B65D 5/723 222/565
2,349,748 A * 5/1944 Otto ..... B65D 5/723 222/565
3,040,953 A 6/1962 Tindall
3,071,304 A 1/1963 Brastad
3,126,141 A 3/1964 Walter
3,136,471 A 6/1964 Brastad
3,229,888 A 1/1966 Gillam
3,303,436 A 5/1967 Peimer
3,819,093 A 6/1974 Forbes et al.
4,081,128 A 3/1978 O'Neill
4,197,985 A 4/1980 Austin
4,609,142 A 9/1986 Adarrek
5,348,219 A 9/1994 Brintazzoli
5,505,373 A 4/1996 Von Stillfried
6,116,499 A 9/2000 Hengami
(Continued)

OTHER PUBLICATIONS

PCT International Search Report and the Written Opinion of the International Searching Authority.

*Primary Examiner* — Christopher Demeree
(74) *Attorney, Agent, or Firm* — Robert J. Lauson; Lauson & Tarver LLP

(57) ABSTRACT

A seal-end package or box for dispensing a solid pourable product includes folding major side panels foldably connected together extending laterally, and formed into a tube around a central axis. Further extending laterally is an overlapping panel similarly folded over and conforming to the tube. A slide is connected to the major side panels, with the overlapping panel having a cover panel with an opening. The slide obstructs the opening, until a thumb tab on the slide engaged by a user and moved laterally relative the axis un-obstructs the opening allowing dispensing of the product.

15 Claims, 8 Drawing Sheets

(56) References Cited

U.S. PATENT DOCUMENTS

| | | | | |
|---|---|---|---|---|
| 6,273,332 | B1 | 8/2001 | Hengami | |
| 6,360,942 | B2 | 3/2002 | Hengami | |
| 6,435,402 | B1 | 8/2002 | Hengami | |
| 6,945,449 | B2 | 9/2005 | Hengami | |
| 7,040,528 | B2 | 5/2006 | Hengami | |
| 7,156,286 | B2 | 1/2007 | Hengami | |
| D551,976 | S | 10/2007 | Hengami | |
| 7,337,904 | B2 | 3/2008 | Hengami | |
| 7,743,973 | B2 | 6/2010 | Hengami | |
| 9,085,386 | B2 | 7/2015 | Hengami | |
| 2004/0004111 | A1 | 1/2004 | Cardinale | |
| 2005/0067476 | A1 | 3/2005 | Hengami | |
| 2006/0124709 | A1 | 6/2006 | Hengami | |
| 2008/0128480 | A1* | 6/2008 | Hegami | B65D 5/723 229/122 |
| 2011/0117258 | A1 | 5/2011 | Burke | |
| 2013/0001284 | A1 | 1/2013 | Hengami | |

* cited by examiner

THUMB ACTION CANDY AND MINT BOX

BACKGROUND

1. Field of the Invention

The present invention relates to packaging for solid pourable product, and more particularly to a specialty box for conveniently dispensing confectioneries or the like.

2. Description of the Related Art

Boxes with end flaps which open for dispensing confectioneries are well known in the art. They are inexpensive and easy to manufacture on a mass scale since they are typically made of a single sheet of paperboard stock which is folded together in a certain sequence to form the box. Most mass-produced boxes, and in particular small candy and mint boxes, are formed, filled and sealed using high speed cartoners, folding 50 to 2000 packages per minute or more. Such high speed packaging machinery typically accepts large quantities of blanks that are each formed into a folding carton in a series of folds, and then open each box, fill it with product, and close the flaps applying an appropriate time-sensitive adhesive to seal the flaps.

Applicant is the inventor of numerous specialty folding box packaging designs having a slider openers for easy dispensing of pourable products and closing of the box for subsequent use, including U.S. Pat. Nos. 6,116,499, 6,273,332, 6,360,942, 6,435,402, 6,945,449, 7,040,528, 7,156,286, 7,337,904, 7,743,973 and 9,085,386. Applicant was also the owner of U.S. Pat. No. 5,505,373, now expired, licensed for the popular CERTS® mints box. Applicant continues to develop packages of new and differing functionality which offer improvements over the prior art including in ease of operation and manufacturing. Among the improvements are those addressing marketability with potential food manufacturers.

Applicant's U.S. Pat. No. 7,743,973 entitled "Thumb-Actuated Candy or Mint Box" formed with a horizontal slide opener provides most convenient and easy utilization of a box, by enabling the consumer to hold this box with one hand and by use of a thumb for example, easily opens to dispense the contents and also close the box as easily. When a user holds the box upright in one hand and opens the box, the user's thumb slides away from the box and the opening is revealed. One drawback of the '973 box is that the blank used to form the box includes an elongated flap that is folded over the slide which may require customized machinery for filling and closing the box. Also, the cost of the blank (material) is more expensive due to a larger blank needed for such a configuration.

Prior art such as the '973 box may require machinery modifications, specialized manufacturing equipment, and extra folding steps to accommodate the elongated flap covering the slide and other unusually shaped structures. And Applicant's '973 design, although innovative, can be refused for high volume production by food companies because of increased material cost. For these reasons, there is a need for a thumb-actuated, sideways sliding box that can be manufactured using existing high speed packaging techniques and conventional folding of short flaps to close the box once it is filled.

3. Objects of the Invention

It is an object of the present invention to provide an improved package having a blank with dimensions and flap sizes corresponding to standard sizes commonly used in a high-speed commercial form and to fill packaging machineries, making it suitable for mass production that all major food producers are already equipped with, and this makes it a convenient transition of using this innovative design that can increase the sale of a product, as consumers have shown they lean towards new designs with convenience of easy utilization.

Another object of the present invention to provide a package comprising a conventional seal-end box that offers a convenient slide opening not tied to the top or bottom of the box.

It is a further object of the present invention to offer a slide opening that moves in a sideways direction perpendicular to the top opening of the box for convenient pourability and ease of use.

It is a further object to provide a package with an opening that is actuated by the user's thumb at the same time not tending to block the opening.

It is a further object to provide a package that conveniently can be utilized single-handedly by the user, to meet today's lifestyle demands of multitasking, i.e. leaving the other hand available for some other task.

It is a further object of the present invention to provide an improved package that can be easily dispensed while the user is engaged in other activities, even while driving, without overly distracting or interfering with the user's operation of the moving vehicle.

It is an object of the present invention to provide an improved package that can be sized to fit well into a user's pocket, while still adaptable for larger sizes such as cereal boxes.

It is a still further object of the present invention to provide a box that is inexpensive, economically produced, and easy to manufacture on a mass scale, for example being made from a smaller single sheet of blank stock material and constructed in such a way to avoid any difficult insertion step for high speed packaging machinery.

These and other objects and advantages of the present invention are more fully discussed in the following summary, description and drawings.

SUMMARY

The present design is a seal-end standard package, such as a box or carton, that standard cartoners normally used in food and other manufacturing to produce large numbers of seal-end boxes can use, thus providing an advantage over prior thumb-actuated boxes or cartons.

A package for dispensing a solid pourable product, such as candy or mints, includes folding side panels connected together and formed into a tube, for example, a square tube, around a common axis. The side panels are secured to maintain the tube shape. A first overlapping panel is connected to the side panels, and a second overlapping panel is connected to the first overlapping panel so that the first overlapping panel and the second overlapping panel extend over and conform to the shape of the tube.

A slide is also connected to the side panels. A cover panel is connected to the second overlapping panel and folds perpendicular to the axis so that the cover panel overlies the slide. The cover panel includes a cover panel opening preferably aligned with a side panel opening located in the side panels. The slide obstructs the cover panel opening and the side panel opening, but when a user moves the slide lateral to the axis, the slide un-obstructs the cover panel opening and the side panel opening, to allow the solid pourable product egress for dispensing it from the package.

The package is preferably formed from a single die-cut blank, and may have four side panels extending laterally across the blank. The slide may be connected to the side panels next to the connection of the first overlapping panel with to the side panels. Like the first and second overlapping panels, the slide also may extend around the package, bringing it adjacent the second overlapping panel and cover panel. The slide should include a stop, and the major panels include a catch that engages the stop to prevent the slide from completely disengaging the cover panel.

A thumb tab is preferably collinear with a panel fold line between the first overlapping panel and the second overlapping panel, and is formed from a cut-out along a slide fold line which is collinear with the panel fold line. An adhesive holds the cover panel against the second overlapping panel, and a top panel is connected to the cover panel opposite the second overlapping panel for folding over the top of the package. Preferably the top panel is coplanar with the top of the package.

A box for dispensing a solid pourable product s preferably configured with four major panels, one preferably having an opening therein, and the four major panels connected together extending laterally and folded into a square-shaped tube about a central axis. The box preferably has one or more additional overlapping panels connected to the four major panels and similarly extending laterally and folded to overlay and conform to the square-shaped tube, and a slide connected to the major panels next to the overlapping panel. A cover panel further extends laterally from the four major panels, the cover panel having an opening overlying the slide. The slide obstructs the cover panel opening until the user moves the slide, thereby un-obstructing the opening and allowing the solid product to be poured from the box.

The package allows for dispensing a solid pourable product when held in a hand and with a thumb due to the orientation of the slide in relation to the package. When the slide moves laterally relative to the axis, the user's thumb clears the opening in the cover panel opening along with the slide, thereby allowing free and immediate egress of the solid pourable product.

DESCRIPTION

Figure 13:
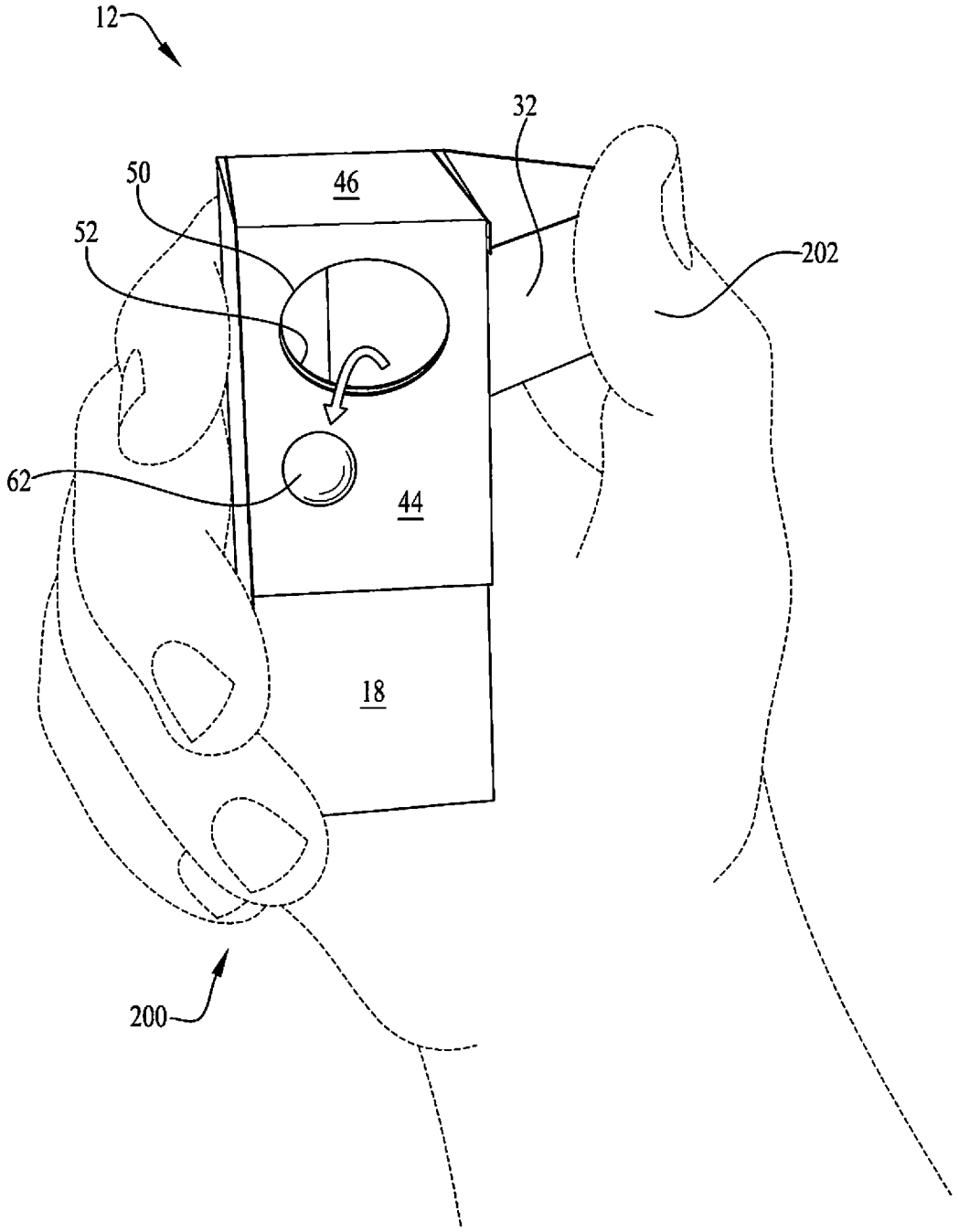
FIG. 13 is a perspective view of a user opening an assembled box to dispense the solid pourable product.
Figure 14:
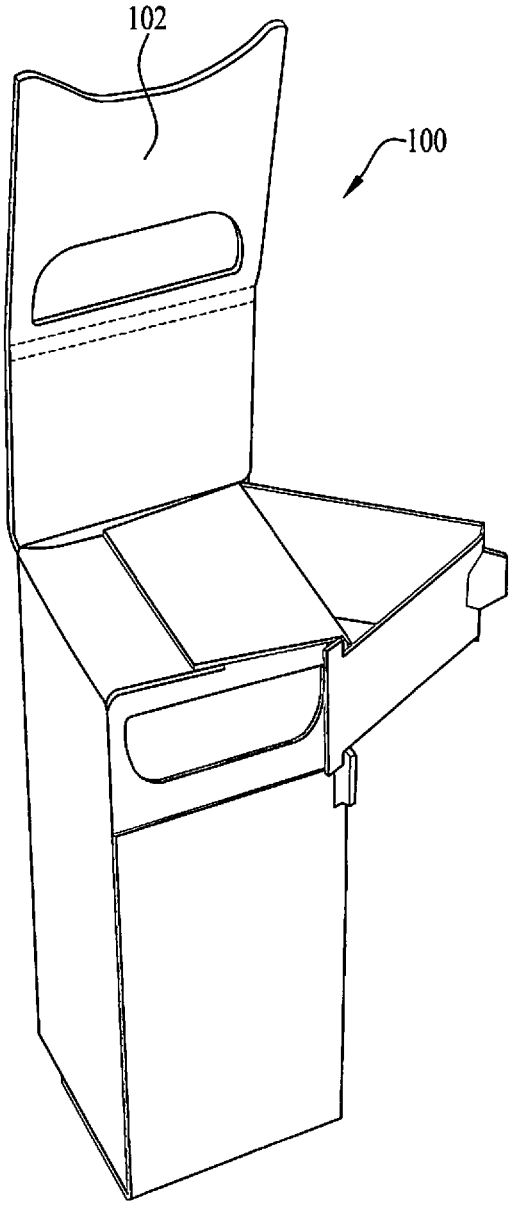
FIG. 14 PRIOR ART
FIG. 14 is a perspective view of a prior art thumb-actuated candy or mint box partially disassembled to show the slide mechanism.
Figure 15:
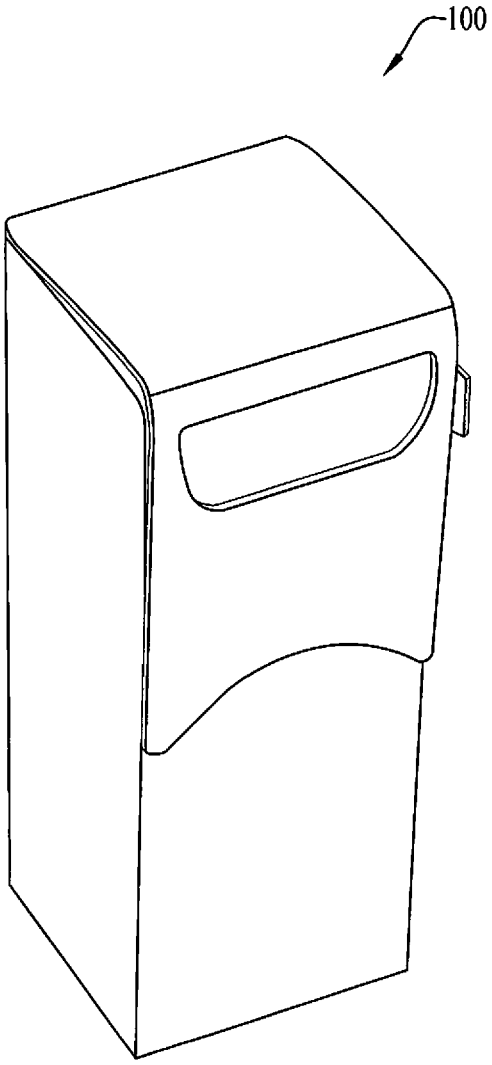
FIG. 15 PRIOR ART
FIG. 15 is a perspective view of the prior art thumb-actuated candy or mint box completely assembled.

Referring initially to FIGS. 14-15 a prior art thumb-actuated candy or mint box 100 is shown. As shown in FIG. 14, while the box 100 has a sideways sliding opening movement, it includes an elongated top flap 102, which extends far beyond the box 100 when unfolded. For this reason, specialized machinery is often necessary to assemble the box 100 resulting in increased costs. For this reason, the improved box 12 of FIGS. 1-13 is cleverly re-configured to avoid this problem and make it compatible with existing high speed packaging machines and thus easier to implement in the marketplace.

Figure 1:
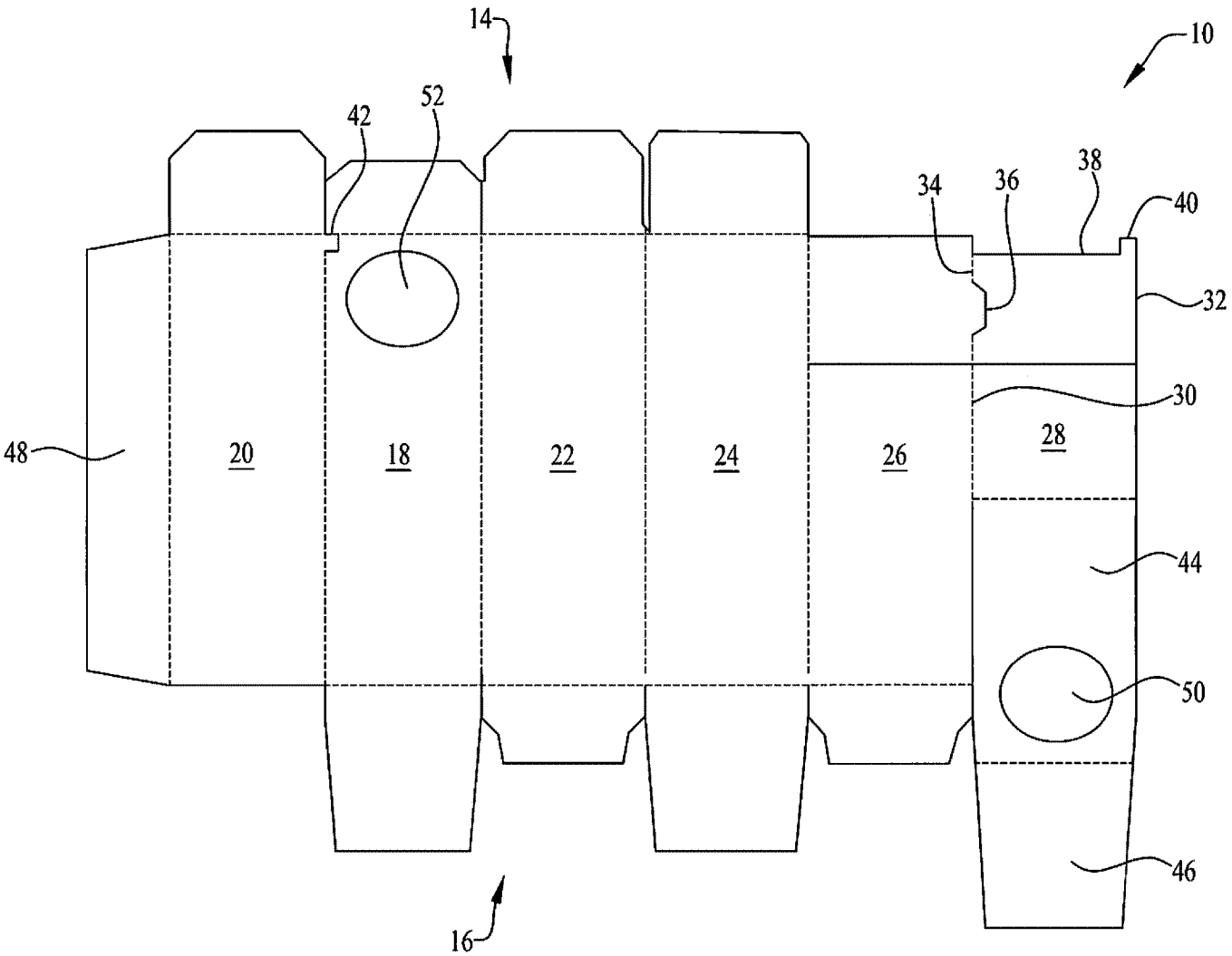
FIG. 1 illustrates a flat pattern view of a stock blank from which an improved convenient, easy open and close laterally thumb actuated candy and mint package is made.

Referring now to FIG. 1, a flat patterned paper or cardboard stock blank 10 is provided for forming a package or box 12. The blank 10 has a top 14 and bottom 16, and preferably four major sides made up of a front panel 18, right side panel 20, left side panel 22 and back panel 24 (collectively, "side panels 18-24") which are generally rectangular in the illustrated embodiment and extend laterally across the blank 10. The side panels 18-24 extend in the other direction between the top 14 and the bottom 16, and the blank 10 is scored for folding.

A first overlapping panel 26 is connected to the back panel 24, and a second overlapping panel 28 is connected to the first overlapping panel 26 along a panel fold line 30. A slide 32 is also connected the back panel 24, shown in the illustrated embodiment adjacent he first overlapping panel 26. The slide 32 is folded along a slide fold line 34, and a thumb tab 36 is die-cut along the slide fold line 34. The slide 32 also includes a notch 38 terminating in a stop 40, the notch 38 extending from the stop 40 to the slide fold line 34. A small portion of the right side panel 20 is cut away to make a catch 42 for engaging the stop 40.

The second overlapping panel 28 has a cover panel 44 for folding over the slide 32. A top panel 46 extends from the cover panel 44 for folding over the top 14. A side tab 48 is connected to the right side panel 20 for folding and adhesion to the back panel 24. A cover panel opening 50 is disposed in the cover panel 44, and a side panel opening 52 is disposed in the front panel 18. When the box 12 is constructed, the cover panel opening 50 and side panel opening 52 align.

Figure 2:
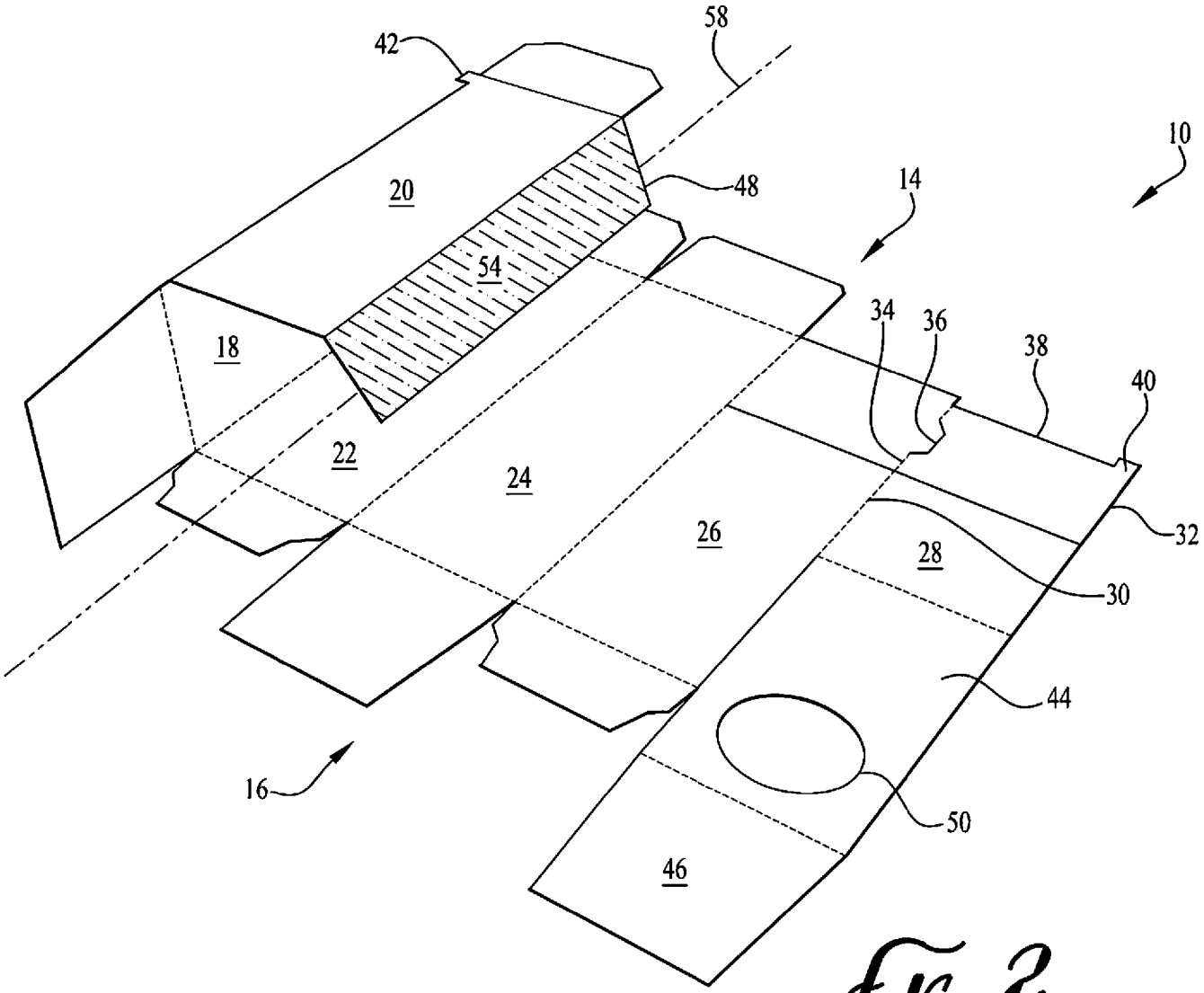
FIG. 2 illustrates a perspective view of the blank being folded in an initial stage of construction.

FIG. 2 shows the blank 10 in an initial stage of folding. The blank 10 folds in a sequence avoiding the need for specialized packaging machinery that might otherwise be necessary to form the slide 32 when the box 12 is assembled. The side tab 48 is folded substantially perpendicular to the right side panel 20, and similar folds are made between the right side panel 20 and front panel 18, the front panel 18 and left side panel 22, and the left side panel 22 and back panel 24. An adhesive 54 on the side tab 48 adheres it to the back panel 24 to locate the side tab 48 adjacent the first overlapping panel 26, thereby forming a tube 56 (FIGS. 3-6) oriented along an axis 58.

Figure 3:
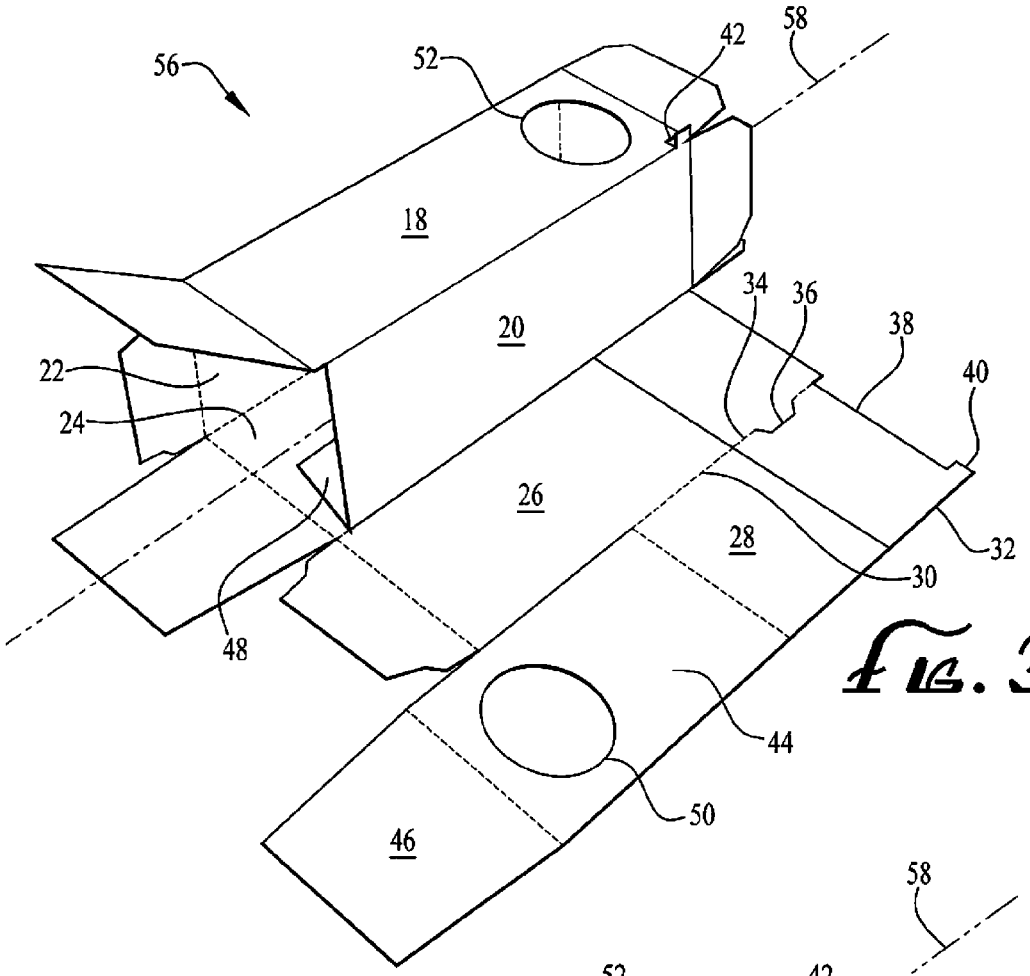
FIG. 3 illustrates a perspective view of the blank being folded in a further stage of construction with the major side panels affixed in position.
Figure 4:
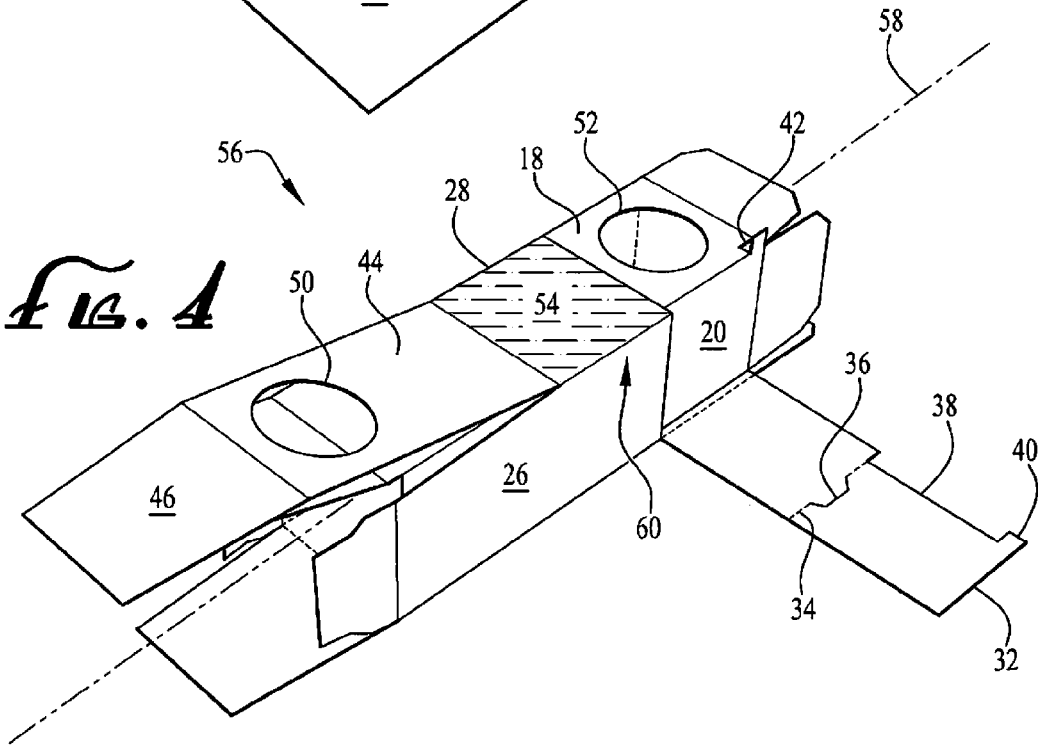
FIG. 4 illustrates a perspective view of a tube formed from the blank with first and second overlapping sides in position over the major side panels.

FIGS. 3-4 show the next stages of assembly. After the front panel 18, right side panel 20, left side panel 22 and back panel 24 are folded and the side tab 48 adhered to the back panel 24, the first overlapping panel 26 is folded up against the right side panel 20. The second overlapping panel 28 is folded up against the front panel 18 along the panel fold line 30. Preferably the second overlapping panel 28 is adhered to the front panel 18, and has additional adhesive 54 for retaining a cover panel 44 coupled to the second overlapping panel 28 and including a cover panel opening 50.

Figure 5:
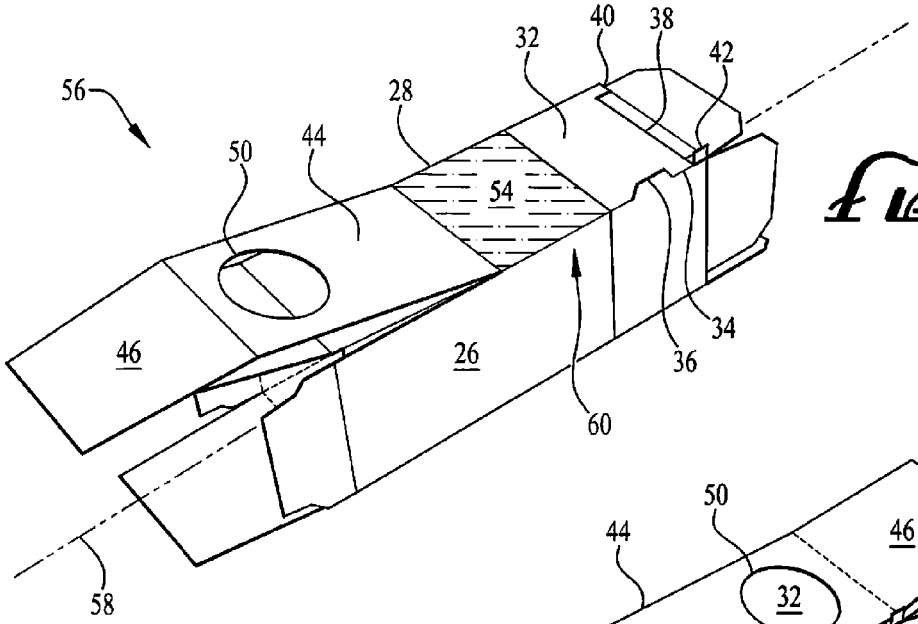
FIG. 5 illustrates a perspective view of the tube with the slide in position over a major side panel opening.
Figure 6:
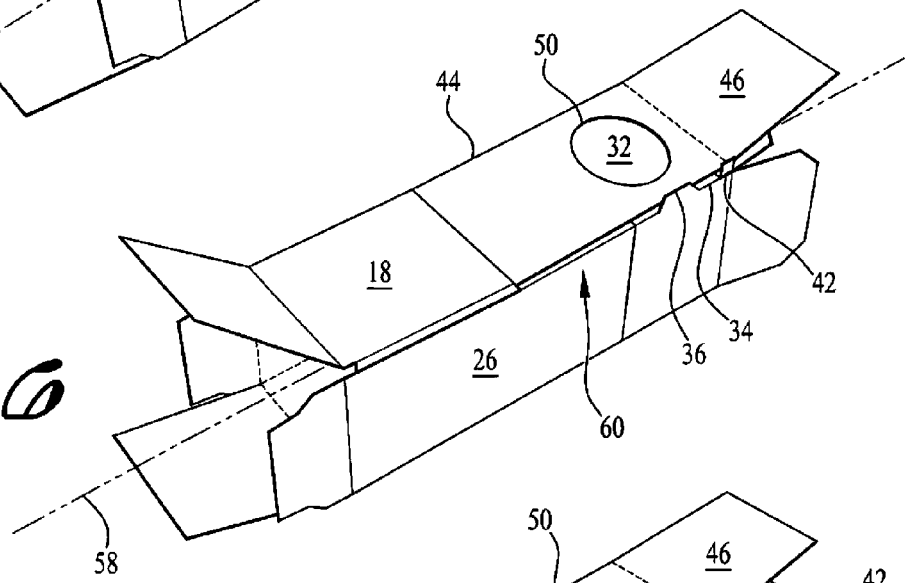
FIG. 6 illustrates a perspective view of the package partially constructed with a cover panel adhered over the slide.
Figure 7:
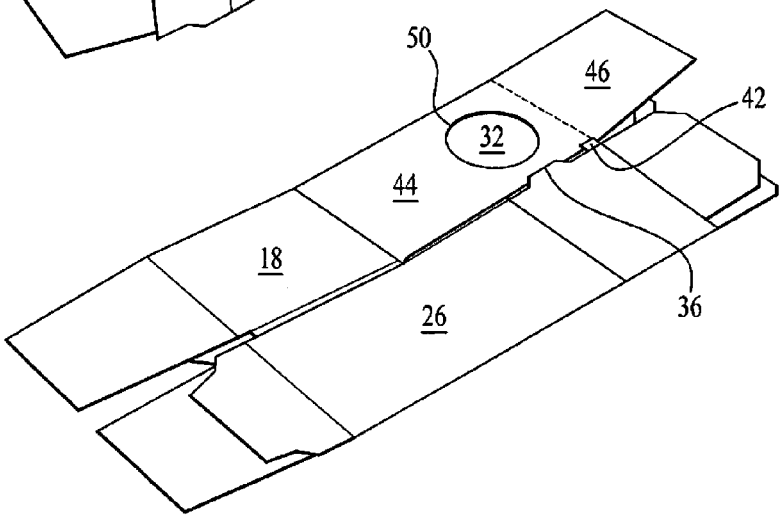
FIG. 7 illustrates a perspective view of the tube flattened for stacking.

FIGS. 5-7 show further assembly of the box 12 resulting in an assembled, collapsed structure ready for stacking and loading in an automatic assembly machine (not shown). Referring to FIG. 5, the slide 32 is brought adjacent to the first overlapping panel 26. The slide 32 folds along the slide fold line 34, extending the thumb tab 36 away from the tube 56. When the slide 32 is fully folded over the tube 56 it overlies both the front panel 18 and the right side panel 20 on a corner 60 common with the first overlapping panel 26 and second overlapping panel 28.

Referring to FIG. 6, the second overlapping panel 28 is adhered to the front panel 18 to secure it in position, with the cover panel 44 adhered to the second overlapping panel 28 so the cover panel opening 50 is over the slide 32, which covers the side panel opening 52. Referring to FIG. 7, with the slide fold line 34 placed collinear with the junction of the first overlapping panel 26 and second overlapping panel 28, the tube 56 can be flattened for stacking prior to use in automated filling machinery.

Figure 8:
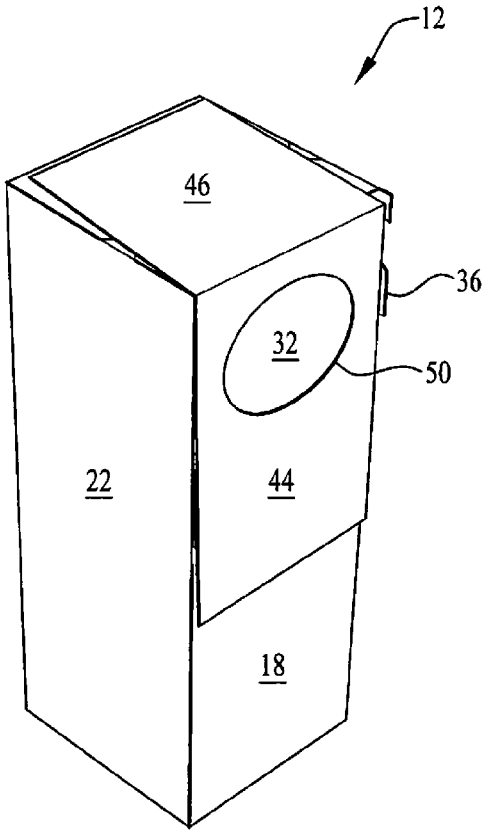
FIG. 8 illustrates a perspective view of the package fully assembled.
Figure 9:
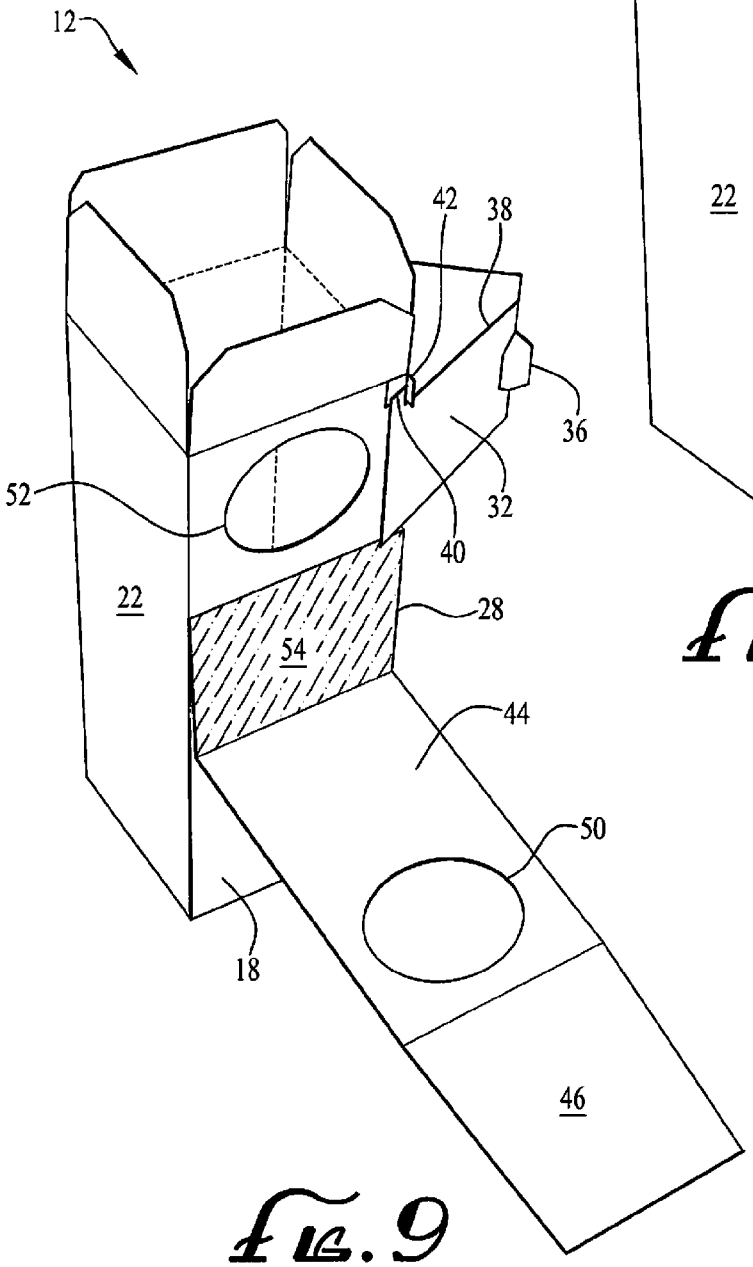
FIG. 9 illustrates a perspective view of the package partially disassembled to show the cover panel and slide mechanism.

Referring to FIGS. 8-9, a preferred embodiment of the completed box 12 is shown. FIG. 8 shows the box 12 partially disassembled for viewing how the slide 32 cooperates with the cover panel 44 and the stop 40 cooperates with the catch 42 to open and close the box 12. FIG. 9 shows the box 12 in a closed arrangement for containing and dispensing a solid pourable product 62 (FIGS. 10-12) such as small candies or mints.

Figure 11:
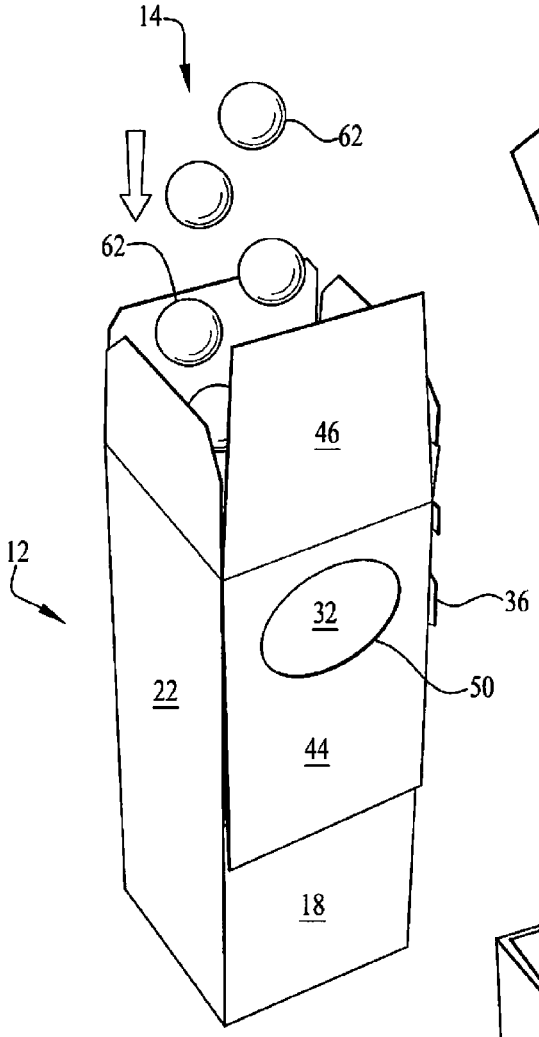
FIG. 11 illustrates a perspective view of the package being filled with the solid pourable product from the top.
Figure 10:
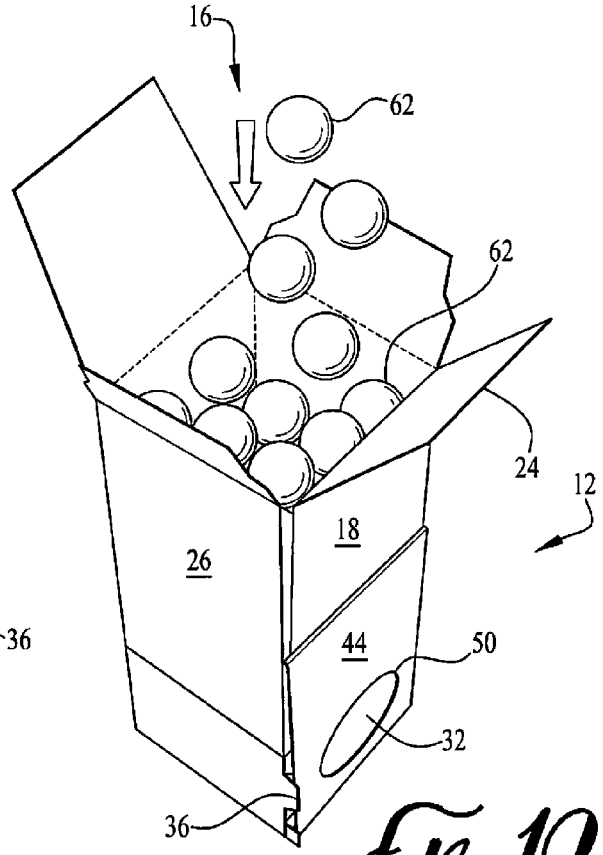
FIG. 10 illustrates a perspective view of the package being filled with a solid pourable product from the bottom.
Figure 12:
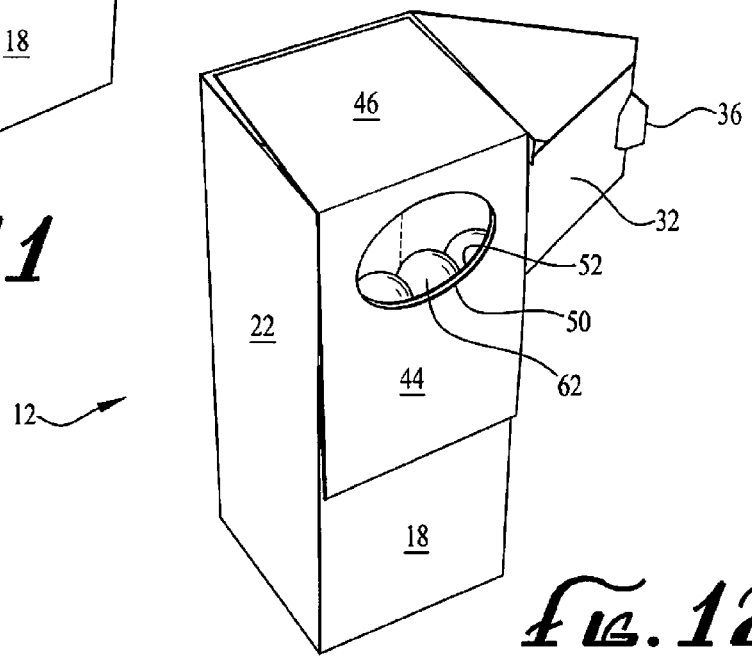
FIG. 12 illustrates a perspective view of an assembled and filled box with the slide open for dispensing the solid pourable product.

FIG. 10 shows the box 12 being filled with solid pourable product 62 introduced into the bottom 16 as is typical for conventional large capacity filling machines. FIG. 11 shows the box 12 being filled with solid pourable product 62 introduced through the top 14 as an alternative. Top 14 or bottom 16 filling may be selected according to preference and equipment. Once the box 12 is filled with solid pourable product 62, it may be sealed prior to distribution and sale. Referring to FIG. 12, the solid pourable product 62 can be easily accessed by urging sliding the thumb tab 36 away from the box 12, simultaneously un-obstructing the cover panel opening 50 and side panel opening 52. The slide 32 is closed by urging the thumb tab 36 in the reverse direction.

Referring to FIG. 13, the box 12 is an improvement over other candy or mint dispensing designs. The cover panel opening 50 and side panel opening 52 face away from a user's hand 200, leaving them unobstructed, while the thumb tab 36 is oriented to slide 32 complimentary to the user's thumb 202. Thus, the user can open and close the box 12 with an easy back-and-forth thumb movement while holding it.

The structure and steps of forming the box 12 having been fully described, its operation will now be discussed.

In order to use the box 12, the blank 10 is folded and flattened as shown in FIG. 7. A series of flattened blanks 10 are stacked and loaded into folding and filling machinery. The machinery removes a flattened blank 10 from the stack, folding it open as shown in FIG. 6. The machinery closes and glues either the top 14 or bottom 16, according to preference. Solid pourable product 62 is introduced into the box 12 and the opposing top 14 or bottom 16 sealed to close the box 12. Multiple filled boxes 12 will typically be assembled and packed for delivery.

When a user purchases the solid pourable product 62 contained in the box 12, the user removes any wrapping or sealing, and grasps the box 12 singlehandedly with the cover panel opening 50 facing away from the user's hand. To open the box 12, the user presses the user's thumb 202 against the thumb tab 36, and urges it away from the box 12. Once the slide 32 clears the cover panel opening 50 and side panel opening 52, a desired quantity of solid pourable product 62 may be dispensed. Then the user urges the thumb tab 36 back toward the box 12 to occlude the cover panel opening 50 and side panel opening 52 in the process. The box 12 may be retained until additional solid pourable product 62 is desired, at which time the user repeats the process.

The foregoing description of the preferred embodiment is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A package for dispensing a solid pourable product, the package comprising:

a plurality of foldably connected side panels having a side panel opening therein and formed into a tube about an axis;

a first overlapping panel connected to the side panels, a second overlapping panel connected to the first overlapping panel, such that the first overlapping panel and the second overlapping panel conform to the tube;

a slide foldably connected to one of the plurality of side panels;

a cover panel having a cover panel opening and foldably connected to the second overlapping panel transverse to the axis, the cover panel overlying the slide;

the cover panel opening aligned with the side panel opening; and the slide obstructing the cover panel opening and the side panel opening, wherein moving the slide lateral to the axis un-obstructs the cover panel opening and the side panel opening allowing solid pourable product egress from the package.

2. The package of claim 1 formed from a single die-cut blank.

3. The package of claim 1 wherein the foldably connected side panels are four side panels.

4. The package of claim 1 wherein the slide is connected to the side panels adjacent the first overlapping panel.

5. The package of claim 1 wherein the slide is adjacent the second overlapping panel.

6. The package of claim 1 wherein the slide has a stop and the side panels have a catch that engages the stop.

7. The package of claim 1 further comprising a thumb tab collinear with a panel fold line between the first overlapping panel and the second overlapping panel.

8. The package of claim 7 wherein the thumb tab is formed from a cut-out along a slide fold line collinear with the panel fold line.

9. The package of claim 1 further comprising an adhesive holding the cover panel against the second overlapping panel.

10. The package of claim 1 further comprising a top panel foldably connected to the cover panel opposite the second overlapping panel, wherein the top panel is coplanar with a top of the package.

11. A box for dispensing a solid pourable product, the box comprising:

four major panels connected together extending laterally and folded from a blank state into a square-shaped tube about a central axis;

an overlapping panel connected to the four major panels and similarly extending laterally and folded to overlay and conform to the square-shaped tube;

a slide foldably connected to one of the four major panels adjacent the overlapping panel;

a cover panel further extending laterally from the four major panels and abutting the overlapping panel when in the blank state, the cover panel having an opening overlying the slide; and the slide obstructing the cover panel opening, wherein moving the slide un-obstructs the cover panel opening allowing solid pourable product egress from the box.

12. The box of claim 11 wherein the slide moves laterally relative the axis, such that the user's thumb clears the cover panel opening as the slide clears the cover panel opening.

13. The box of claim 11 wherein the slide has a thumb tab extending from the package.

14. The box of claim 11 wherein the slide further comprises a stop and the major panels further comprise a catch that engages the stop.

15. The box of claim 11 wherein the box is a single die-cut blank.

* * * * *